US011885201B2

(12) United States Patent
Gan et al.

(10) Patent No.: US 11,885,201 B2
(45) Date of Patent: Jan. 30, 2024

(54) SLIDING SLEEVE

(71) Applicants: China Petroleum & Chemical Corporation, Beijing (CN); Sinopec Southwest Oil & Gas Company, Chengdu (CN)

(72) Inventors: Zhenwei Gan, Chengdu (CN); Bin Qi, Chengdu (CN); Shunqu Hu, Chengdu (CN); Zhimin Hou, Chengdu (CN); Yongmao Lin, Chengdu (CN); Tao Liu, Chengdu (CN); Chen Chen, Chengdu (CN); Lei Wang, Chengdu (CN); Dan Hu, Chengdu (CN); Jiang Qian, Chengdu (CN)

(73) Assignees: China Petroleum & Chemical Corporation, Beijing (CN); Sinopec Southwest Oil & Gas Company, Sichuan (CN)

( * ) Notice: Subject to any disclaimer, the term of this patent is extended or adjusted under 35 U.S.C. 154(b) by 1163 days.

(21) Appl. No.: 16/071,111

(22) PCT Filed: Jan. 13, 2017

(86) PCT No.: PCT/CN2017/071166

§ 371 (c)(1),
(2) Date: Jul. 19, 2018

(87) PCT Pub. No.: WO2017/124978

PCT Pub. Date: Jul. 27, 2017

(65) Prior Publication Data

US 2021/0189833 A1 Jun. 24, 2021

(30) Foreign Application Priority Data

Jan. 20, 2016 (CN) ..... 201610036843.6
Jan. 20, 2016 (CN) ..... 201610037103.4
(Continued)

(51) Int. Cl.
*E21B 34/14* (2006.01)
*E21B 34/06* (2006.01)
*E21B 43/26* (2006.01)

(52) U.S. Cl.
CPC ..... *E21B 34/14* (2013.01); *E21B 34/063* (2013.01); *E21B 43/26* (2013.01); *E21B 2200/06* (2020.05); *E21B 2200/08* (2020.05)

(58) Field of Classification Search
CPC ..... E21B 34/14; E21B 34/063; E21B 43/26; E21B 2200/06; E21B 2200/08
(Continued)

(56) References Cited

U.S. PATENT DOCUMENTS 8,757,265 B1 * 6/2014 Cuffe ..... E21B 34/10 166/308.1
8,944,169 B2 * 2/2015 Campbell ..... E21B 21/103 166/308.1
(Continued)

FOREIGN PATENT DOCUMENTS

CN 2861472 Y 1/2007
CN 103556971 A 2/2014
(Continued)

OTHER PUBLICATIONS

International Search Report for International Application No. PCT/CN2017/071166, dated Apr. 11, 2017.

*Primary Examiner* — Matthew R Buck
*Assistant Examiner* — Patrick F Lambe
(74) *Attorney, Agent, or Firm* — Finnegan, Henderson, Farabow, Garrett & Dunner LLP

(57) ABSTRACT

A new sliding sleeve relates to the technical field of oil and gas well completion and reservoir stimulation, comprising an upper connector, a lower connector, an outer housing, an inner sleeve and a shear pin. The upper connector and the
(Continued)

lower connector are respectively connected to two ends of the outer housing, and the inner sleeve is locked in the outer housing via the shear pin, wherein a flow guiding hole is provided in the outer housing, and the inner sleeve can open or close the flow guiding hole, wherein at least two grooves for engaging with at least two corresponding tooth-shaped elements on a sliding sleeve opening tool are disposed along an axial direction in the inner sleeve, and wherein an erosion-resistant ring is embedded in the groove, and an inner diameter of the erosion-resistant ring is larger than or equal to an inner diameter of the inner sleeve.

25 Claims, 16 Drawing Sheets

(30) Foreign Application Priority Data

Jan. 20, 2016 (CN) ..... 201610037341.5
Jan. 20, 2016 (CN) ..... 201610037797.1
Jan. 20, 2016 (CN) ..... 201610038915.0
Jan. 20, 2016 (CN) ..... 201620054067.8

(58) Field of Classification Search
USPC ..... 166/317
See application file for complete search history.

(56) References Cited

U.S. PATENT DOCUMENTS

| | | | | |
|---|---|---|---|---|
| 10,364,647 | B2 * | 7/2019 | Sargent | E21B 34/10 |
| 2006/0185852 | A1 | 8/2006 | Ross et al. | |
| 2008/0257558 | A1 | 10/2008 | Darnell et al. | |
| 2015/0041133 | A1 * | 2/2015 | Chauffe | E21B 34/063 166/284 |
| 2015/0308206 | A1 * | 10/2015 | Yue | E21B 23/06 166/387 |

FOREIGN PATENT DOCUMENTS

| | | | | |
|---|---|---|---|---|
| CN | 105672943 | A | * | 6/2016 |
| CN | 105672943 | A | | 6/2016 |
| CN | 105672946 | A | | 6/2016 |
| CN | 105672947 | A | * | 6/2016 |
| CN | 105672947 | A | | 6/2016 |
| CN | 105696972 | A | * | 6/2016 |
| CN | 105696972 | A | | 6/2016 |
| CN | 105696975 | A | | 6/2016 |
| CN | 205503092 | U | * | 8/2016 |
| CN | 205503092 | U | | 8/2016 |

* cited by examiner

SLIDING SLEEVE

CROSS-REFERENCE TO RELATED APPLICATIONS

This application is a national stage filing under 35 U.S.C. § 371 of International Application No. PCT/CN2017/071166, filed on Jan. 13, 2017, which claims priority of Chinese Patent Application No. CN201610036843.6, filed Jan. 20, 2016, Chinese Patent Application No. CN201610037103.4, filed Jan. 20, 2016, Chinese Patent Application No. CN201610038915.0, filed Jan. 20, 2016, Chinese Patent Application No. CN201610037341.5, filed Jan. 20, 2016, Chinese Patent Application No. CN201610037797.1, filed Jan. 20, 2016, and Chinese Patent Application No. CN201620054067.8, filed Jan. 20, 2016. The contents of these applications are each incorporated herein by reference.

FIELD OF THE INVENTION

The present disclosure relates to the technical field of oil and gas well completion and reservoir stimulation, and in particular, to a new sliding sleeve.

BACKGROUND OF THE INVENTION

With the development of oil and gas reservoirs towards tight reservoirs with low permeability, relevant traditional tool technologies can no longer meet requirements. A sliding sleeve is one of key tools for communicating with annulus between tubing and casing and achieving staged fracturing during a fracturing process. During a gas production test process of oil and gas well completion, the annulus between tubing and casing is communicated by an opening action of the sliding sleeve so as to achieve operations such as circulation, fluid replacement, sand fracturing. Only one sliding sleeve is needed in one-stage stimulation. However, a plurality of sliding sleeves need to be connected in sequence on one tubing string during multi-stage stimulation. During the multi-stage stimulation, a stage is fractured after a corresponding stage of sliding sleeve is opened, and multiple stages are fractured from bottom to top. With exploration and development of tight gas reservoir, a horizontal segment of a horizontal well becomes increasingly longer, and stages for sand fracturing become more and more. Technologies of ten stages of, twenty stages of or even tens of stages of sliding sleeves are needed.

However, it is difficult to open sliding sleeves stage by stage, and it is more difficult to ensure that sealing performance on an upper side and sealing performance on a lower side of the sliding sleeve meet production requirements after the sliding sleeve is opened.

In Chinese patent application "Full-bore sliding sleeve for staged fracturing used in gas and oil operations", a new ball-dropped sliding sleeve comprising a step-type movement structure is disclosed. According to the technology, sliding sleeves can be opened stage by stage by dropping in balls of a same size in sequence. Theoretically, the number of stages is not limited, and all sliding sleeves can be kept full-bore. However, there is a risk of sand sticking in actual use of the sliding sleeve. As a result, there is a possibility that a fracture stage is missed because a corresponding sliding sleeve cannot be opened normally. In addition, since upper and lower sealing structures are not designed on the sliding sleeve, blow-by at upper and lower ends of the sliding sleeve easily occurs in fracturing stimulation.

To this end, it is an urgent problem for those skilled in the art to invent a new sliding sleeve which can effectively avoid failure of the sliding sleeve and blow-by at upper and lower ends of the sliding sleeve.

SUMMARY OF THE INVENTION

The main purpose of the present disclosure is to provide a new sliding sleeve, which can effectively avoid failure of a sliding sleeve and blow-by at upper and lower ends of the sliding sleeve, can be repeatedly opened or closed, and facilitates stimulation.

To achieve the above purpose, the present disclosure provides a new sliding sleeve.

The new sliding sleeve comprises an upper connector, a lower connector, an outer housing, an inner sleeve and a shear pin.

The upper connector and the lower connector are respectively connected to two ends of the outer housing, and the inner sleeve is locked in the outer housing via the shear pin.

A flow guiding hole is provided in the outer housing, and the inner sleeve can open or close the flow guiding hole.

At least one groove for engaging with at least one corresponding tooth-shaped element on a sliding sleeve opening tool is disposed along an axial direction in the inner sleeve, and an erosion-resistant ring is embedded in the groove, with an inner diameter of the erosion-resistant ring being larger than or equal to an inner diameter of the inner sleeve.

According to the new sliding sleeve, the inner sleeve comprises a first inner sleeve and a second inner sleeve, and the first inner sleeve and the second inner sleeve are connected to each other by welding, a thread, or a thread plus welding.

According to the new sliding sleeve, a sealing rubber barrel and a retaining ring are further included, and a chamfer for fitting the sealing rubber barrel is disposed in the inner sleeve. The sealing rubber barrel is embedded into the chamfer, and a position of the sealing rubber barrel is limited by the retaining ring disposed under the sealing rubber barrel.

According to the new sliding sleeve, a movable element is disposed among a lower end of the inner sleeve, the outer housing and the retaining ring; a positioning ring is disposed at a downside position of the retaining ring; and an annular space is formed by the outer housing, the movable element, the retaining ring and the positioning ring.

According to the new sliding sleeve, the lower end of the inner sleeve and the movable element are connected to each other via a thread, and the retaining ring and the positioning ring are connected to each other via a thread.

According to the new sliding sleeve, the movable element is an elastic piece structure which compresses the retaining ring circumferentially, and the retaining ring and the positioning ring are connected to each other via a thread.

According to the new sliding sleeve, a movable element is disposed among a lower end of the inner sleeve, the outer housing and the retaining ring. The movable element is a clamp ring and is used to enable the inner sleeve and the retaining ring to be fixed relative to each other. An annular space is formed by the outer housing, the inner sleeve and the retaining ring.

According to the new sliding sleeve, a sealing ring is disposed between the positioning ring and the outer housing.

According to the new sliding sleeve, at least one pressure relief hole is disposed in the retaining ring, and the pressure relief hole is in communication with the annular space.

According to the new sliding sleeve, at least one surface of the sealing rubber barrel is uneven, so that a gap exists between the sealing rubber barrel and the chamfer, and/or between the sealing rubber barrel and the retaining ring.

According to the new sliding sleeve, a surface of the chamfer and/or a surface of the retaining ring close to the sealing rubber barrel are/is uneven, so that a gap exists between the sealing rubber barrel and the chamfer, and/or between the sealing rubber barrel and the retaining ring.

According to the new sliding sleeve, a spacer is disposed on at least one side of the sealing rubber barrel, and at least one surface of the spacer is uneven, so that a gap exists between the sealing rubber barrel and the chamfer, and/or between the sealing rubber barrel and the retaining ring.

According to the new sliding sleeve, concave-convex teeth, and/or a groove, and/or a ring groove, are disposed on at least one surface of the spacer.

According to the new sliding sleeve, a movable space is formed among an inner surface of the outer housing, the inner sleeve and the lower connector, and a first dissolvable structure is filled in the movable space.

According to the new sliding sleeve, an inner diameter of the first dissolvable structure is larger than or equal to the inner diameter of the inner sleeve, and the inner diameter of the first dissolvable structure is larger than or equal to an inner diameter of the lower connector.

According to the new sliding sleeve, the first dissolvable structure is made of magnalium alloy, phenolic resin, urea resin, epoxy resin, or polyimide.

According to the new sliding sleeve, a second dissolvable structure is further filled in the groove.

According to the new sliding sleeve, an inner diameter of the second dissolvable structure is larger than or equal to the inner diameter of the inner sleeve.

According to the new sliding sleeve, the second dissolvable structure is made of magnalium alloy, phenolic resin, urea resin, epoxy resin, or polyimide.

According to the new sliding sleeve, an open/close structure is disposed between the inner sleeve and the outer housing, and the open/close structure enables the inner sleeve to be fixed when the inner sleeve closes or opens the flow guiding hole.

According to the new sliding sleeve, the open/close structure is an arched position-limiting elastic piece. A protrusion is disposed on the arched position-limiting elastic piece, and the protrusion can be fitted into a first slot or a second slot correspondingly disposed on an inner surface of the outer housing.

According to the new sliding sleeve, the open/close structure is an anchor-fluke position-limiting elastic piece. The anchor-fluke position-limiting elastic piece has anchor flukes, and the anchor flukes can be fitted into a first groove or a second groove correspondingly disposed on an inner surface of the outer housing.

According to the new sliding sleeve, a first slot is close to the upper connector, and a second slot is close to the lower connector. A side wall of the first slot close to the upper connector gradually inclines towards the upper connector, and an angle between a side wall of the first slot close to the lower connector and an inner surface of the outer housing is larger than 45°. A side wall of the second slot close to the lower connector gradually inclines towards the lower connector, and an angle between a side wall of the second slot close to the upper connector and the inner surface of the outer housing is larger than 45°.

According to the new sliding sleeve, the open/close structure is an L-shaped groove. An end of the L-shaped groove close to the lower connector is a closing block part extending along an axial direction of the inner sleeve, and an end of the L-shaped groove close to the upper connector is an opening block part extending along a direction perpendicular to an extending direction of the closing block part. The shear pin can be blocked at the closing block part or the opening block part.

According to the new sliding sleeve, the open/close structure is a J-shaped groove, an end of the J-shaped groove close to the lower connector is a closing block part extending along an axial direction of the inner sleeve, and an end of the J-shaped groove close to the upper connector is a triangular opening block part extending along a direction perpendicular to an extending direction of the closing block part. The shear pin can be blocked at the closing block part or the opening block part.

The present disclosure has following beneficial effects.

1. By disposing the erosion-resistant ring in the inner sleeve or coating an erosion-resistant material on key parts, a capability of the sliding sleeve to resist an erosion effect formed when high-speed sand-carrying fluid flows through the groove on the inner sleeve is greatly improved, so that usability of a tool can be improved and service life of the tool can be prolonged.

2. By disposing the sealing rubber barrel on the inner surface of the inner sleeve of the sliding sleeve, the sealing rubber barrel cannot be easily worn. Moreover, blow-by at upper and lower ends of the sliding sleeve during a fracture stimulation process can be effectively avoided, and the sealing effect is good. Besides, by disposing gaps at two ends of the sealing rubber barrel, pre-compression of sealing rubber barrel can be avoided, whereby work reliability can be improved. In addition, the structure of the sliding sleeve is simple and is easy to install.

3. By pre-filling a dissolvable structure in the movable space of the inner sleeve and in the groove on the inner wall of the inner sleeve, unbeneficial effects brought about by blocking of the well cementation slurry in the movable space and the groove can be avoided. After fracture stimulation, a wellbore can be kept full-bore, which is especially beneficial for later-stage operations on the oil and gas wells, and the sliding sleeve can be opened and closed repeatedly.

4. By disposing an open/close structure between the outer housing and the inner sleeve and disposing a corresponding slot on the outer housing, the sliding sleeve can be opened by using the sliding sleeve opening tool and the sliding sleeve can be locked at a desired position. In a later stage, matching open/close tools of coiled tubing can be used as needed to perform closing and opening operations repeatedly. Thus, the sliding sleeve has many advantages, such as convenient for stimulation and flexible to use. This is of important practical significance for shortening operation periods, reducing operation cost, and facilitating later-stage management of oil and gas wells.

BRIEF DESCRIPTION OF THE DRAWINGS

The present disclosure will be explained in details based on the embodiments and with reference to the accompanying drawings. In the drawings.

Figure 1:
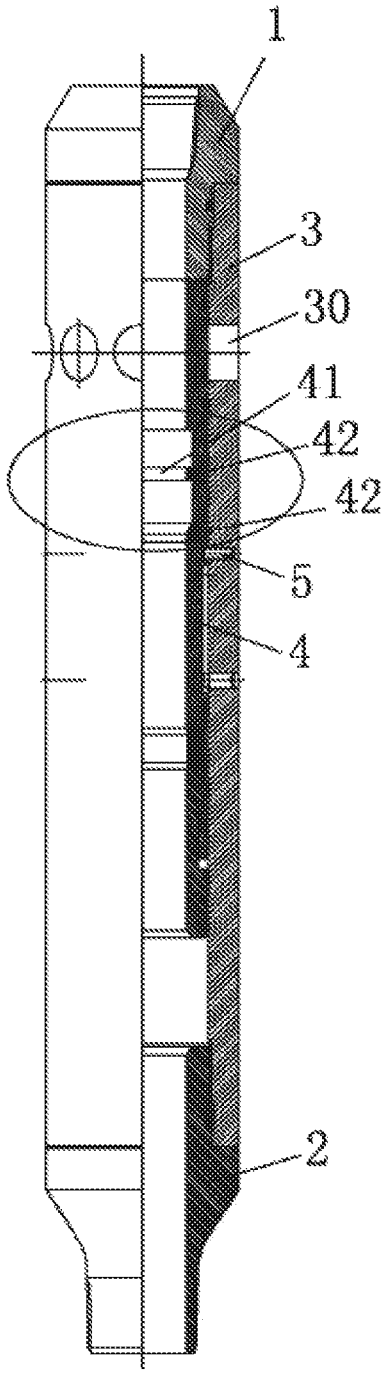
FIG. 1 schematically shows a structure of a first embodiment of the present disclosure.

In the drawings, same components are represented by same reference signs, and a size of a component does not represent an actual size of the corresponding component.

DETAILED DESCRIPTION OF THE EMBODIMENTS

The present disclosure will be further explained in detail with reference to the accompanying drawings.

As shown in FIG. 1, according to a first embodiment of the present disclosure, a new sliding sleeve is provided. The sliding sleeve mainly comprises: an upper connector 1, a lower connector 2, an outer housing 3, an inner sleeve 4 and a shear pin 5. The upper connector 1 and lower connector 2 are respectively connected to two ends of the outer housing 3, and the inner sleeve 4 is locked in the outer housing 3 via the shear pin 5. A flow guiding hole 30 is provided in the outer housing 3, and the inner sleeve 4 can open or close the flow guiding hole 30. At least one groove 41 for engaging with at least one corresponding tooth-shaped element on a sliding sleeve opening tool is disposed along an axial direction in the inner sleeve 4. An erosion-resistant ring 42 is embedded in the groove 41, and an inner diameter of the erosion-resistant ring 42 is equal to an inner diameter of the inner sleeve. In other words, a height of an inner surface of the erosion-resistant ring 42 is consistent with a height of an inner surface of the inner sleeve 4. When high-speed sand-carrying fluid flows through the groove 41 of the inner sleeve 4, a high-speed whirlpool will be formed at the groove 41 because of changing of flow patterns, and a position of the erosion-resistant ring 42 will bear especially large erosion. A capability for resisting high-speed sand-carrying fluid erosion can be improved by embedding an erosion-resistant ring in this position. The inner diameter of the erosion-resistant ring 42 can also be larger than the inner diameter of the inner sleeve 4.

Figure 1A:
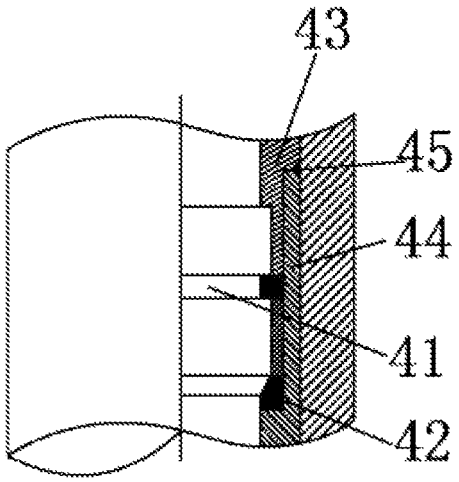
FIG. 1*a* schematically shows an erosion-resistant ring, part of which is connected by welding.
Figure 1B:
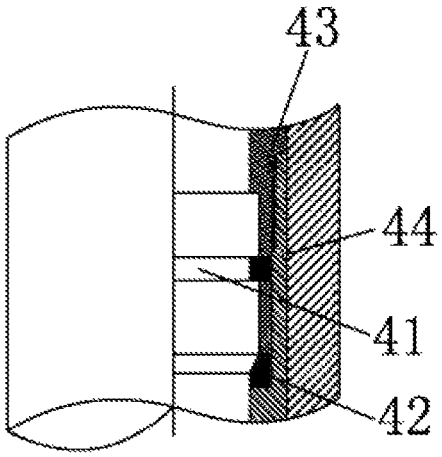
FIG. 1*b* schematically shows an erosion-resistant ring, part of which is connected via a thread plus sealing ring.
Figure 1C:
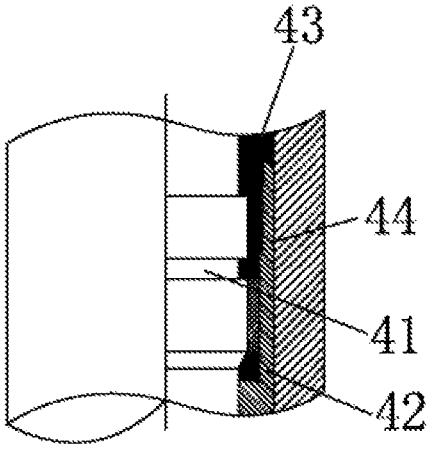
FIG. 1*c* schematically shows an erosion-resistant ring, part of which is connected by a thread plus welding.

The inner sleeve 4 comprises a first inner sleeve 43 and a second inner sleeve 44, and the first inner sleeve 43 and the second inner sleeve 44 are connected to each other by welding 45 (FIG. 1*a*), a thread (FIG. 1*b*), or a thread plus welding (FIG. 1*c*). Assembled first inner sleeve 43 and second inner sleeve 44 are convenient for installation. Moreover, a structure formed by welding, a thread, or a thread plus welding is stable, and has high safety.

Preferably, an erosion-resistant material for making the erosion-resistant ring 42 can be hard alloy or plating of diamond, but the material is not limited to materials listed above.

Figure 2:
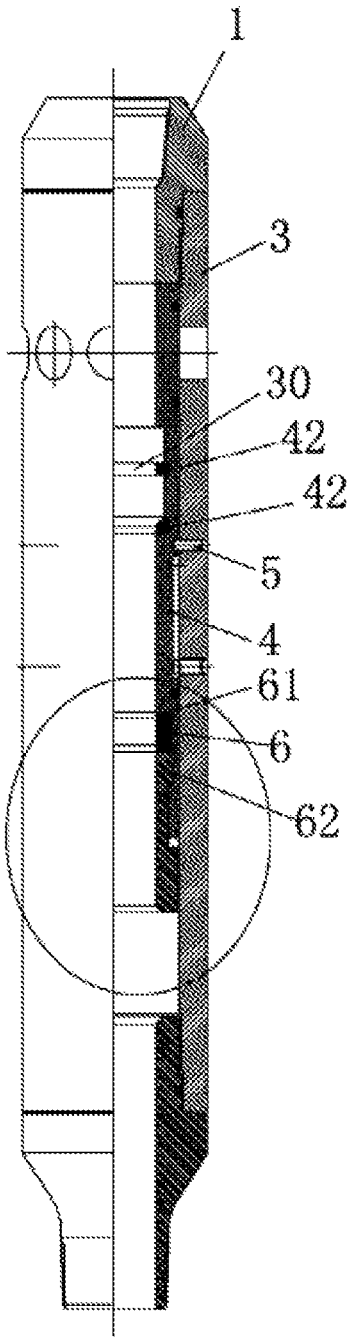
FIG. 2 schematically shows a structure of a second embodiment of the present disclosure.

As shown in FIG. 2, according to a second embodiment of the present disclosure, a chamfer 61 for fitting a sealing rubber barrel 6 is disposed in the inner sleeve 4. The sealing rubber barrel 6 is embedded into the chamfer 61, and a position of the sealing rubber barrel 6 is limited by a retaining ring 62 disposed under the sealing rubber barrel 6. When the sliding sleeve opening tool (not shown) pushes the inner sleeve 4 to move downwards, the sealing rubber barrel 6 is easily extruded along an axial direction of the inner sleeve 4, so that the sealing rubber barrel 6 expands inwards along a radial direction. Further, an annular gap between the inner sleeve 4 and the sliding sleeve opening tool is sealed, whereby blow-by at upper and lower ends of the sliding sleeve can be effectively avoided during a fracture stimulation process. Preferably, a movable element 63 is disposed among a lower end of the inner sleeve 4, the outer housing 3 and the retaining ring 62; a positioning ring 64 is disposed at a downside position of the retaining ring 62; and an annular space 65 is formed by the outer housing 3, the movable element 63, the retaining ring 62 and the positioning ring 64. The annular space 65 is used for providing a buffer space when the rubber barrel 6 is radially compressed.

Figure 2A:
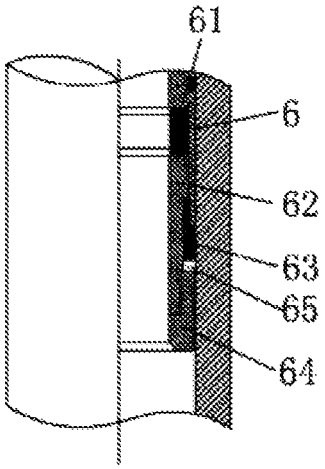
FIG. 2*a* schematically shows a structure of a positioning ring having a thread structure.
Figure 2B:
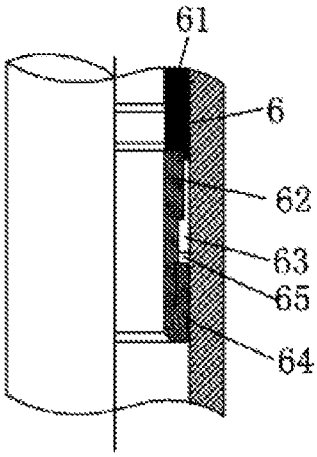
FIG. 2*b* schematically shows a structure of a positioning ring having an elastic piece structure.
Figure 2C:
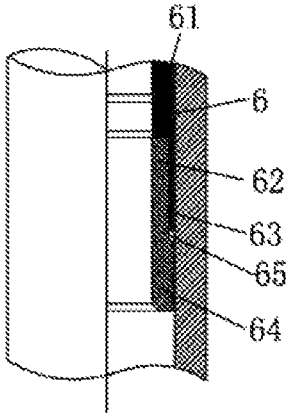
FIG. 2*c* schematically shows a structure of a positioning ring having a clamp ring structure.

There are a plurality of connection manners for the retaining ring 62, the movable element 63, and the positioning ring 64. As shown in FIG. 2*a*, the lower end of the inner sleeve 4 and the movable element 63 can be connected to each other via a thread, and the retaining ring 62 and the positioning ring 64 can be connected to each other via a thread. As shown in 2*b*, the movable element 63 can be an elastic piece structure which compresses the retaining ring 62 circumferentially, and the retaining ring 62 and the positioning ring 64 can be connected to each other via a thread. As shown in FIG. 2*c*, a movable element 63 is disposed among the lower end of the inner sleeve 4, the outer housing 3 and the retaining ring 62. The movable element 63 is a clamp ring, and is used to enable the inner sleeve 4 and the retaining ring 62 to be fixed relative to each other. An annular space 65 is formed by the outer housing 3, the inner sleeve 4 and the retaining ring 62.

Figure 3:
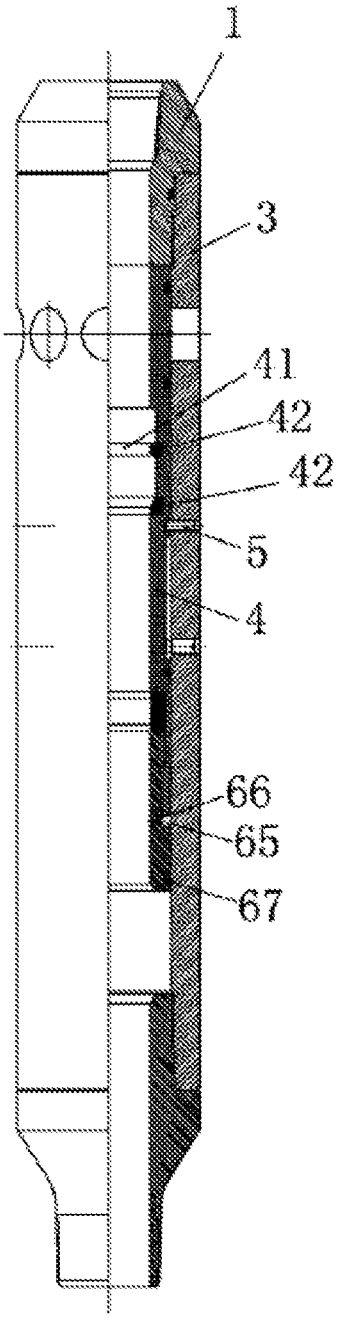
FIG. 3 schematically shows a structure of a third embodiment of the present disclosure.
Figure 4B:
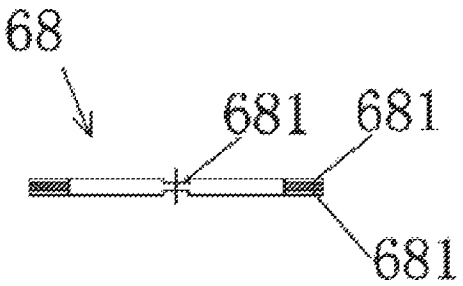
FIG. 4*b* is a front view of a spacer, on two surfaces of which a groove is disposed, in a fourth embodiment of the present disclosure.
Figure 4A:
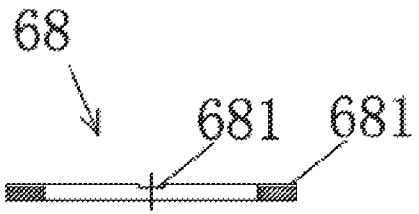
FIG. 4*a* is a front view of a spacer, on one surface of which a groove is disposed, in a fourth embodiment of the present disclosure.
Figure 4C:
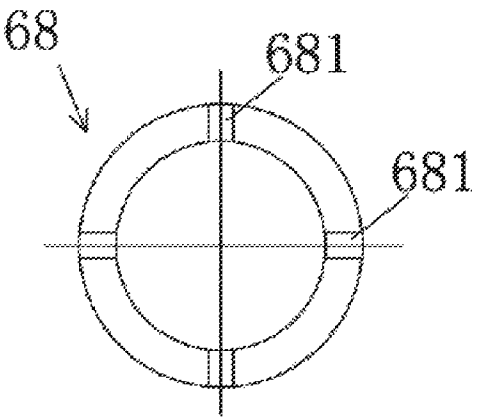
FIG. 4*c* is a top view of a spacer, on a surface of which a groove is disposed, in a fourth embodiment of the present disclosure.
Figure 4E:
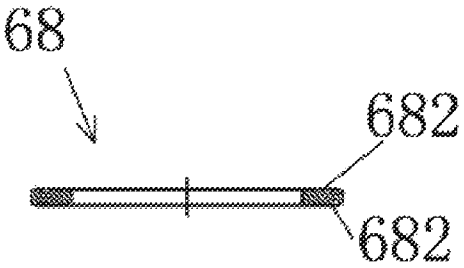
FIG. 4*e* is a front view of a spacer, on two surfaces of which a ring groove is disposed, in a fourth embodiment of the present disclosure.
Figure 4D:
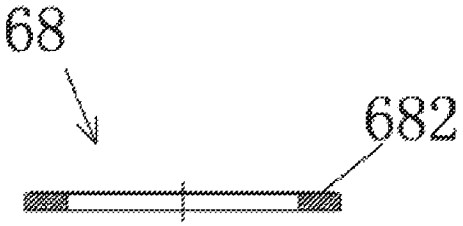
FIG. 4*d* is a front view of a spacer, on one surface of which a ring groove is disposed, in a fourth embodiment of the present disclosure.
Figure 4F:
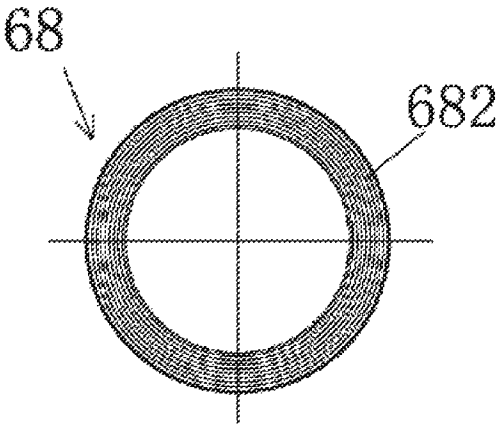
FIG. 4*f* is a top view of a spacer, on a surface of which a ring groove is disposed, in a fourth embodiment of the present disclosure.
Figure 4H:
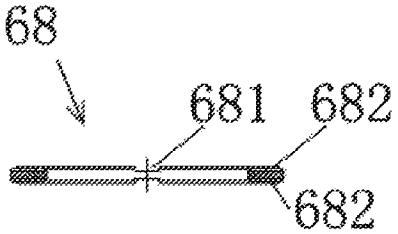
FIG. 4*h* is a front view of a spacer, on two surfaces of which a groove and a ring groove are disposed, in a fourth embodiment of the present disclosure.
Figure 4G:
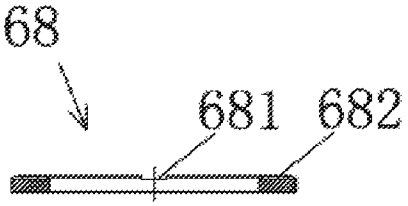
FIG. 4*g* is a front view of a spacer, on one surface of which a groove and a ring groove are disposed, in a fourth embodiment of the present disclosure.
Figure 4I:
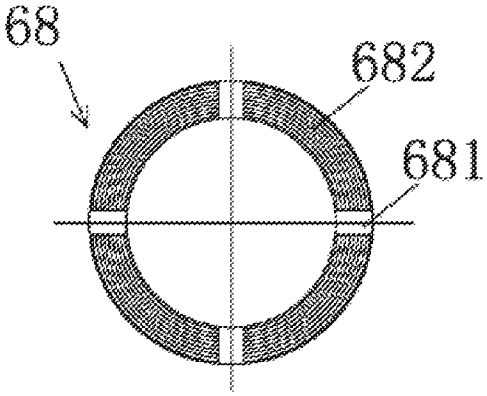
FIG. 4*i* is a top view of a spacer, on a surface of which a groove and a ring groove are disposed, in a fourth embodiment of the present disclosure.

As shown in FIG. 3, according to a third embodiment of the present disclosure, at least one pressure relief hole 66 is disposed in the retaining ring 62, and the pressure relief hole 66 is in communication with the annular space 65.

In addition, preferably, a sealing ring 67 can be disposed between the positioning ring 64 and the outer housing 3, and the sealing ring 67 mainly serves to block sand.

Preferably, at least one surface of the sealing rubber barrel 6 is uneven, so that a gap exists between the sealing rubber barrel 6 and the chamfer 61, and/or between the sealing rubber barrel 6 and the retaining ring 62, and the gap serves to balance a pressure difference between two ends of the seal rubber barrel 6. Alternatively, a surface of the chamfer 61 and/or a surface of the retaining ring 62 close to the sealing rubber barrel 6 are/is uneven, so that a gap can also exist between the sealing rubber barrel 6 and the chamfer 61, and/or between the sealing rubber barrel 6 and retaining ring 62.

In addition, as shown in FIGS. 4*a* to 4*i*, according to a fourth embodiment, a spacer 68 can also be disposed. Specifically, the spacer 68 is disposed on at least one side of the sealing rubber barrel 6, and at least one surface of the spacer 68 is uneven, so that a gap exists between the sealing rubber barrel 6 and the chamfer 61, and/or between the sealing rubber barrel 6 and retaining ring 62. Preferably, concave-convex teeth (not shown), and/or a groove 681 (FIG. 4*a* to FIG. 4*c*), and/or a ring groove 682 (FIG. 4*d* to FIG. 4*f*, and FIG. 4*g* to FIG. 4*i*), are disposed on at least one surface of the spacer 68.

Figure 5:
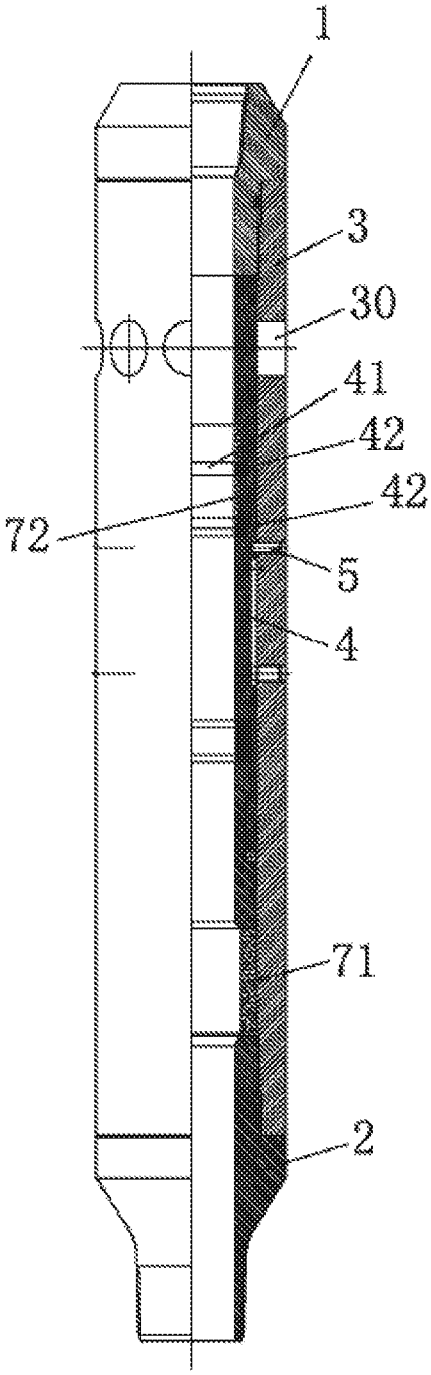
FIG. 5 schematically shows a structure of a fifth embodiment of the present disclosure.

As shown in FIG. 5, according to a fifth embodiment of the present disclosure, a movable space is formed among an inner surface of the outer housing 3, the inner sleeve 4 and the lower connector 2, and a first dissolvable structure 71 is filled in the movable space. Preferably, the first dissolvable structure 71 is basically in a ring shape. An inner diameter of the first dissolvable structure 71 is larger than or equal to the inner diameter of the inner sleeve 4, and the inner diameter of the first dissolvable structure 71 is larger than or equal to an inner diameter of the lower connector 2. The purpose of such disposing is to ensure that the movable space is not blocked by well cementing slurry. This is because after the first dissolvable structure 71 is dissolved, the movable space can be completely emptied, so that the inner sleeve 4 can slide towards the lower connector 2 smoothly and the flow guiding hole 30 in the outer housing 3 can be opened.

In addition, a second dissolvable structure 72 is filled in the groove 41. Preferably, the second dissolvable structure 72 is also basically in a ring shape, and an inner diameter of the second dissolvable structure 72 is larger than or equal to the inner diameter of the inner sleeve 4. The purpose of such disposing is to ensure that when the sliding sleeve opening tool is used, the groove 41 in the inner sleeve 4 is not blocked by the well cementing slurry. This is because after the second dissolvable structure 72 is dissolved, the groove 41 can be completely emptied, so that the sliding sleeve opening tool can be fitted in the groove 41 on the inner sleeve 4 smoothly. Accordingly, the inner sleeve 4 can move towards the lower connector 2 smoothly, and the flow guiding hole 30 in the outer housing 3 can be opened.

Both the first dissolvable structure 71 and the second dissolvable structure 72 can be made of a dissolvable material, such as magnalium alloy, phenolic resin, urea resin, epoxy resin, polyimide, but the material is not limited to materials listed above.

Figure 6A:
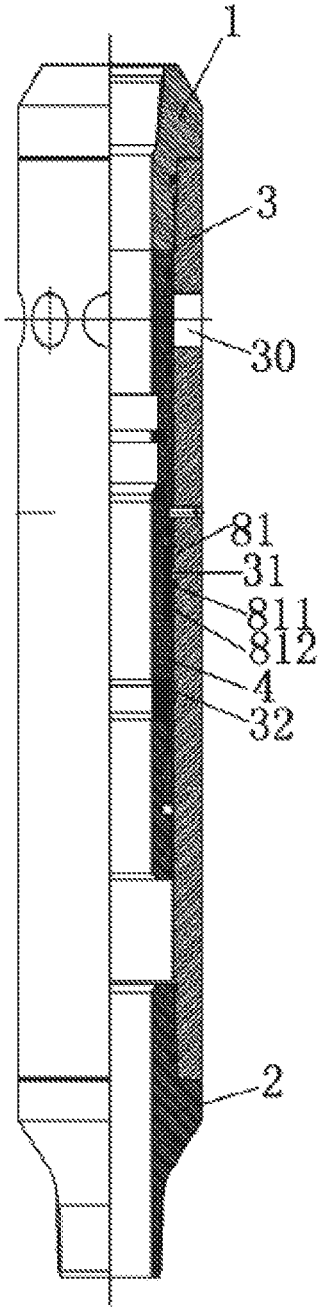
FIG. 6*a* is a schematic view of a sixth embodiment of the present disclosure when an arched position-limiting elastic piece is used and a sliding sleeve is closed.
Figure 6B:
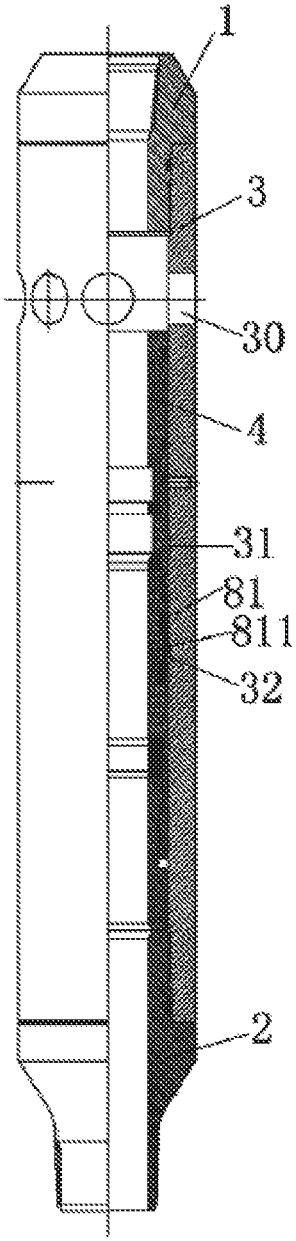
FIG. 6*b* is a schematic view of a sixth embodiment of the present disclosure when the arched position-limiting elastic piece is used and the sliding sleeve is opened.

In addition, an open/close structure is disposed between the inner sleeve 4 and the outer housing 3, and the open/close structure enables the inner sleeve to be fixed when the flow guiding hole 30 is opened or closed by the inner sleeve 4. Specifically, as shown in FIG. 6*a* and FIG. 6*b*, according to a sixth embodiment, the open/close structure is an arched position-limiting elastic piece 81. A protrusion 811 is disposed on the arched position-limiting elastic piece 81, and the protrusion 811 can be fitted into a first slot 31 or a second slot 32 correspondingly disposed on an inner surface of the outer housing 3. Grooves 812, a quantity and a shape of which match a quantity and a shape of the arched position-limiting elastic piece 81, are disposed on an outer wall of the inner sleeve 4. Preferably, there are two or more arched position-limiting elastic pieces 81 and grooves 812 which are distributed circumferentially.

There are two slots. A slot close to the upper connector 1 is defined as the first slot 31, and a slot close to the lower connector 2 is defined as the second slot 32. When the protrusion 811 on the arched position-limiting elastic piece 81 is fitted into the first slot 31, the flow guiding hole 30 in the outer housing 3 can be exactly closed by the inner sleeve 4. When the protrusion 811 on the arched position-limiting elastic piece 81 is fitted into the second slot 32, the flow guiding hole 30 in the outer housing 3 can be exactly opened by the inner sleeve 4. Preferably, a side wall of the first slot 31 close to the upper connector 1 gradually inclines towards the upper connector 1, and more preferably, an angle thereof is smaller than 45°.

An angle between a side wall of the first slot 31 close to the lower connector 2 and an inner surface of the outer housing 3 is larger than 45°. The reason for such disposing is that when the protrusion 811 on the arched position-limiting elastic piece 81 is fitted into the first slot 31, the inner sleeve 4 tends to move towards the upper connector 1, rather than towards the lower connector 2 (it should be explained that, a certain tonnage, which is sufficient for overcoming an upward force received by the inner sleeve 4 under a certain pressure difference, is required for the inner sleeve 4 to move towards the lower connector 2, and this helps to keep the sliding sleeve in a closed state during a production process). Accordingly, it can be ensured that the inner sleeve 4 is kept in a state that the flow guiding hole 30 in the outer housing 3 is closed. For the same purpose, a side wall of the second slot 32 close to the lower connector 2 gradually inclines towards the lower connector 2. Preferably, an angle thereof is smaller than 45°. An angle between a side wall of the second slot 32 close to the upper connector 1 and the inner surface of the outer housing 3 is larger than 45°. Thus, when the protrusion 811 on the arched position-limiting elastic piece 81 is fitted into the second slot 32, the inner sleeve 4 tends to move towards the lower connector 2, rather than towards the upper connector 1 (it should be explained that, a certain tonnage, which is sufficient for overcoming a down pushing force received by the inner sleeve 4 under a certain pressure difference, is required for the inner sleeve 4 to move towards the upper connector 1, and this helps to keep the sliding sleeve in an open state). Accordingly, it can be ensured that the inner sleeve 4 is kept in a state that the flow guiding hole 30 in the outer housing 3 is opened.

By disposing the arched position-limiting elastic piece 81 between the outer housing 3 and the inner sleeve 4 and disposing corresponding slots (31, 32) on the outer housing 3, the sliding sleeve can be opened by using the sliding sleeve opening tool, and the sliding sleeve can be locked at a desired position. In a later stage, matching open/close tools of coiled tubing can be used as needed to perform closing and opening operations repeatedly. Thus, the sliding sleeve has many advantages, such as convenient for stimulation and flexible to use. This is of important practical significance for shortening operation periods, reducing operation cost, and facilitating later-stage management of oil and gas wells.

Figure 7A:
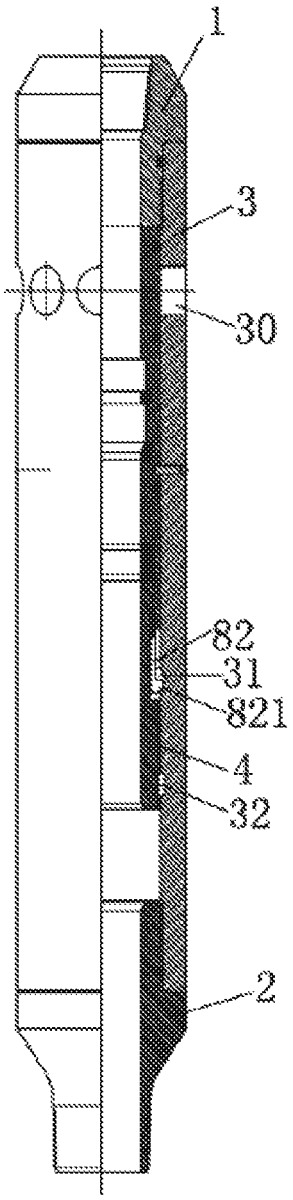
FIG. 7*a* is a schematic view of a seventh embodiment of the present disclosure when an anchor-fluke position-limiting elastic piece is used and a sliding sleeve is closed.
Figure 7B:
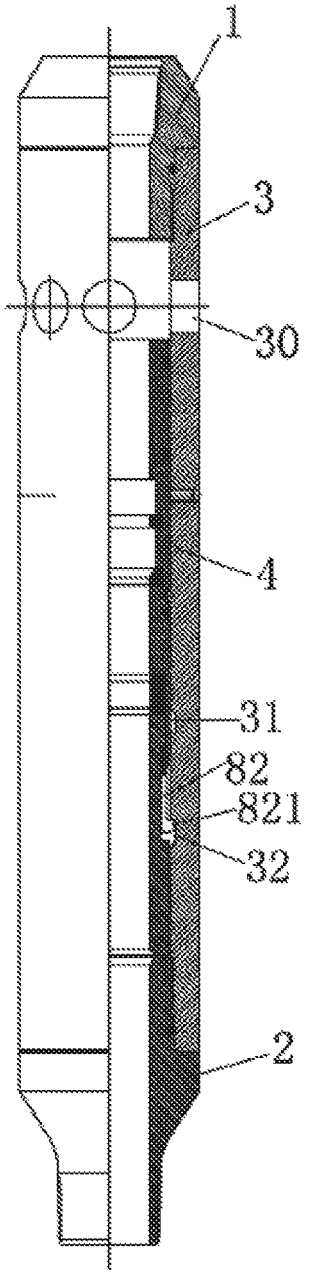
FIG. 7*b* is a schematic view of a seventh embodiment of the present disclosure when the anchor-fluke position-limiting elastic piece is used and the sliding sleeve is opened.

Specifically, as shown in FIG. 7*a* and FIG. 7*b*, according to a seventh embodiment, the open/close structure is an anchor-fluke position-limiting elastic piece 82. The anchor-fluke position-limiting elastic piece 82 has a plurality of anchor flukes 821 distributed circumferentially. The anchor flukes 821 can be fitted into the first groove 31 or the second groove 32 correspondingly disposed on the inner surface of the outer housing 3.

There are two slots. A slot close to the upper connector 1 is defined as the first slot 31, and a slot close to the lower connector 2 is defined as the second slot 32. When the anchor flukes 821 on the anchor-fluke position-limiting elastic piece 82 are fitted into the first slot 31, the flow guiding hole 30 in the outer housing 3 can be exactly closed by the inner sleeve 4; and when the anchor flukes 821 on the anchor-fluke position-limiting elastic piece 82 are fitted into the second slot 32, the flow guiding hole 30 in the outer housing 3 can be exactly closed by the inner sleeve 4.

Preferably, a side wall of the first slot 31 close to the upper connector 1 gradually inclines towards the upper connector 1, and preferably, an angle thereof is smaller than 45°. An angle between a side wall of the first slot 31 close to the lower connector 2 and an inner surface of the outer housing 3 is larger than 45°. The reason for such disposing is that when the anchor flukes 821 on the anchor-fluke position-limiting elastic piece 82 are fitted into the first slot 31, the inner sleeve 4 tends to move towards the upper connector 1, rather than towards the lower connector 2. Accordingly, it can be ensured that the inner sleeve 4 is kept in a state that the flow guiding hole 30 in the outer housing 3 is closed. For the same purpose, a side wall of the second slot 32 close to the lower connector 2 gradually inclines towards the lower connector 2, and preferably, an angle thereof is smaller than 45°. An angle between a side wall of the second slot 32 close to the upper connector 1 and an inner surface of the outer housing 3 is larger than 45°. Thus, when the anchor flukes 821 on the anchor-fluke position-limiting elastic piece 82 are fitted into the second slot 32, the inner sleeve 4 tends to move towards the lower connector 2, rather than the upper connector 1. Accordingly, it can be ensured that the inner sleeve 4 is kept in a state that the flow guiding hole 30 in the outer housing 3 is opened.

By disposing anchor-fluke position-limiting elastic piece 82 between the outer housing 3 and the inner sleeve 4 and disposing corresponding slots (31, 32) on the outer housing 3, the sliding sleeve can be opened by using the sliding sleeve opening tool, and the sliding sleeve can be locked at a desired position. In a later stage, matching open/close tools of coiled tubing can be used as needed to perform closing and opening operations repeatedly. Thus, the sliding sleeve has many advantages, such as convenient for stimulation and flexible to use. This is of important practical significance for shortening operation periods, reducing operation cost, and facilitating later-stage management of oil and gas wells.

Figure 8A:
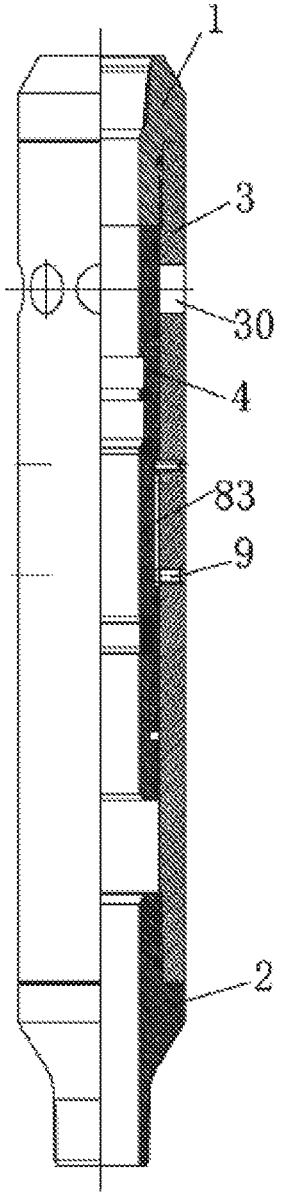
FIG. 8*a* is a schematic view of an eighth embodiment of the present disclosure when a sliding sleeve with an open/close structure to be unlocked by a pin is used and a sliding sleeve is closed.
Figure 8B:
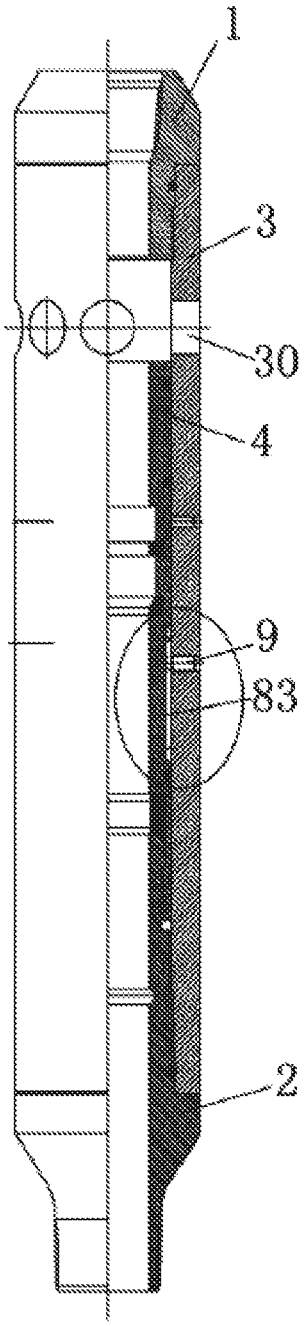
FIG. 8*b* is a schematic view of an eighth embodiment of the present disclosure when the sliding sleeve with an open/close structure to be unlocked by a pin is used and the sliding sleeve is opened.
Figure 8C:
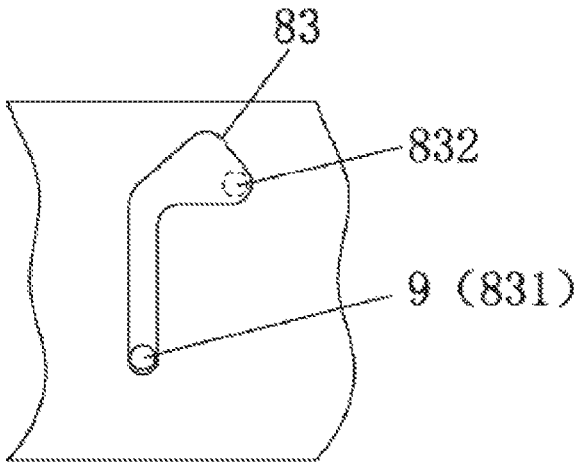
FIG. 8*c* schematically shows an open/close structure which is an L-shaped groove.

Specifically, as shown in FIG. 8*a* to FIG. 8*c*, according to an eighth embodiment, the open/close structure is an L-shaped groove 83, and the L-shaped groove 83 is disposed on a side wall of the inner sleeve 4. An end of the L-shaped groove 83 close to the lower connector 2 is a closing block part 831 extending along an axial direction of the inner sleeve 4, and an end of the L-shaped groove 83 close to the upper connector 1 is an opening block part 832 extending along a direction perpendicular to an extending direction of the closing block part 831. Correspondingly, a positioning pin 9 protruding towards the open/close structure (i.e., the L-shaped groove 83) is disposed fixedly on the outer housing 3. When the positioning pin 9 is moved to the closing block part 831 of the L-shaped groove 83, the flow guiding hole 30 in the outer housing 3 is exactly closed by the outer housing 4. When the positioning pin 9 is moved to the opening block part 832 of the L-shaped groove 83, it means that the outer housing 4 has moved towards the lower connector 2. At this time, the flow guiding hole 30 in the outer housing 3 is exactly opened by the outer housing 4, and fluid flowing between interior and exterior of the sliding sleeve can be achieved.

Figure 8D:
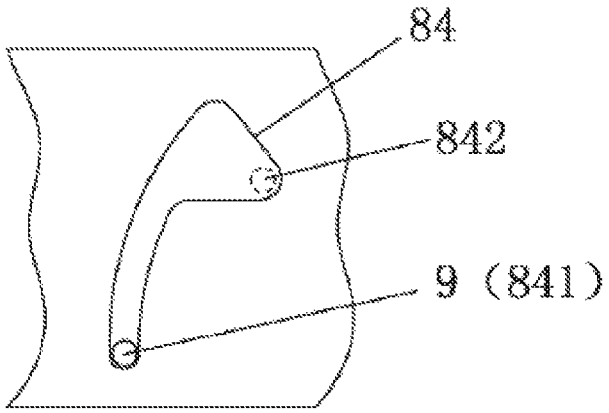
FIG. 8*d* schematically shows an open/close structure which is a J-shaped groove.

As a substitution for the L-shaped groove 83, the open/close structure can be a J-shaped groove 84, which is shown in FIG. 8*d*. The J-shaped groove 84 is disposed on the side wall of the inner sleeve 4. An end of the J-shaped groove 84 close to the lower connector 2 is a closing block part 841 extending along an axial direction of the inner sleeve 4, and an end of the J-shaped groove 84 close to the upper connector 1 is a basically triangular opening block part 842 extending along a direction perpendicular to an extending direction of the closing block part 841. When the positioning pin 9 is moved to the closing block part 841 of the J-shaped groove 84, the flow guiding hole 30 in the outer housing 3 is exactly closed by the outer housing 4. When the positioning pin 9 is moved to the opening block part 842 of the J-shaped groove 84, it means that the outer housing 4 has moved towards the lower connector 2. At this time, the flow guiding hole 30 in the outer housing 3 is exactly opened by the outer housing 4, and fluid flowing between interior and exterior of the sliding sleeve can be achieved.

It should be noted that, the open/close structure in the present disclosure is not limited to the L-shaped groove or the J-shaped groove. As long as it can be achieved that the positioning pin 9 on the outer housing 3 is blocked in different positions of an open/close structure so as to change mutual positions of the inner sleeve 4 and the outer housing 3, the open/close structure is acceptable. Moreover, the quantity of the open/close structure is not limited to one, and there can be two open/close structures disposed symmetrically on the inner sleeve 4 (so as to ensure that the inner sleeve 4 and the outer housing 3 can maintain a desired mutual position relationship) or more.

By disposing the open/close structure on the inner sleeve 4 and correspondingly disposing the positioning pin 9 on the outer housing 3, the sliding sleeve can be opened by using the sliding sleeve opening tool, and the sliding sleeve can be locked at a desired position. In a later stage, matching open/close tools of coiled tubing can be used as needed to perform closing and opening operations repeatedly. Thus, the sliding sleeve has many advantages, such as convenient for stimulation and flexible to use. This is of important practical significance for shortening operation periods, reducing operation cost, and facilitating later-stage management of oil and gas wells.

To sum up, the present disclosure has following beneficial effects.

1. By disposing the erosion-resistant ring in the inner sleeve or coating an erosion-resistant material on key parts, a capability of the sliding sleeve to resist an erosion effect formed when the high-speed sand-carrying fluid flows through the groove on the inner sleeve is greatly improved, so that usability of a tool can be improved and service life of the tool can be prolonged.

2. By disposing the sealing rubber barrel on the inner surface of the inner sleeve of the sliding sleeve, the sealing rubber barrel cannot be easily worn. Moreover, by disposing gaps at two ends of the sealing rubber barrel, blow-by at upper and lower ends of the sliding sleeve during a fracture stimulation process can be effectively avoided. The sealing effect is good, which improves work reliability. In addition, the structure of the sliding sleeve is simple and is easy to install.

3. By pre-filling a dissolvable structure in the movable space of the inner sleeve and in the groove on the inner wall of the inner sleeve, unbeneficial effects brought about by blocking of the well cementation slurry in the movable space and the groove can be avoided. After fracture stimulation, a wellbore can be kept full bore, which is especially beneficial for later-stage operations on the oil and gas wells, and the sliding sleeve can be opened and closed repeatedly.

4. By disposing an open/close structure between the outer housing and the inner sleeve and disposing a corresponding slot on the outer housing, the sliding sleeve can be opened by using the sliding sleeve opening tool and the sliding sleeve can be locked at a desired position. In a later stage, matching open/close tools of coiled tubing can be used as needed to perform closing and opening operations repeatedly. Thus, the sliding sleeve has many advantages, such as convenient for stimulation and flexible to use. This is of important practical significance for shortening operation periods, reducing operation cost, and facilitating later-stage management of oil and gas wells.

The present disclosure is illustrated in detail in combination with preferred embodiments hereinabove, but it can be understood that the embodiments disclosed herein can be improved or substituted without departing from the protection scope of the present disclosure. In particular, as long as there are no structural conflicts, the technical features disclosed in each and every embodiment of the present disclosure can be combined with one another in any way, and the combined features formed thereby are within the protection scope of the present disclosure. The present disclosure is not limited by the specific embodiments disclosed herein, but includes all technical solutions falling into the protection scope of the claims.

The invention claimed is:

1. A new sliding sleeve, comprising an upper connector, a lower connector, an outer housing, an inner sleeve and a shear pin, wherein the upper connector and the lower connector are respectively connected to two ends of the outer housing, and the inner sleeve is locked in the outer housing via the shear pin;

wherein a flow guiding hole is provided in the outer housing, and the inner sleeve can open or close the flow guiding hole; and wherein at least one groove for engaging with at least one corresponding tooth-shaped element on a sliding sleeve opening tool is disposed along an axial direction in the inner sleeve, and an erosion-resistant ring is embedded in the groove, with an inner diameter of the erosion-resistant ring being larger than or equal to an inner diameter of the inner sleeve.

2. The new sliding sleeve according to claim 1, wherein the inner sleeve comprises a first inner sleeve and a second inner sleeve, and the first inner sleeve and the second inner sleeve are connected to each other by welding, a thread, or a thread plus welding.

3. The new sliding sleeve according to claim 1, wherein the new sliding sleeve further comprises a sealing rubber barrel and a retaining ring, and a chamfer for fitting the sealing rubber barrel is disposed in the inner sleeve, wherein the sealing rubber barrel is embedded into the chamfer, and a position of the sealing rubber barrel is limited by the retaining ring disposed under the sealing rubber barrel.

4. The new sliding sleeve according to claim 3, wherein a movable element is disposed among a lower end of the inner sleeve, the outer housing and the retaining ring; a positioning ring is disposed at a downside position of the retaining ring; and an annular space is formed by the outer housing, the movable element, the retaining ring and the positioning ring.

5. The new sliding sleeve according to claim 4, wherein the lower end of the inner sleeve and the movable element are connected to each other via a thread, and the retaining ring and the positioning ring are connected to each other via a thread.

6. The new sliding sleeve according to claim 4, wherein the movable element is an elastic piece structure which compresses the retaining ring circumferentially, and the retaining ring and the positioning ring are connected to each other via a thread.

7. The new sliding sleeve according to claim 3, wherein a movable element is disposed among a lower end of the inner sleeve, the outer housing and the retaining ring, wherein the movable element is a clamp ring and is used to enable the inner sleeve and the retaining ring to be fixed relative to each other, and an annular space is formed by the outer housing, the inner sleeve and the retaining ring.

8. The new sliding sleeve according to claim 4, wherein a sealing ring is disposed between the positioning ring and the outer housing.

9. The new sliding sleeve according to claim 8, wherein at least one pressure relief hole is disposed in the retaining ring, and the pressure relief hole is in communication with the annular space.

10. The new sliding sleeve according to claim 3, wherein at least one surface of the sealing rubber barrel is uneven, so that a gap exists between the sealing rubber barrel and the chamfer, and/or between the sealing rubber barrel and the retaining ring.

11. The new sliding sleeve according to claim 3, wherein a surface of the chamfer and/or a surface of the retaining ring close to the sealing rubber barrel are/is uneven, so that a gap exists between the sealing rubber barrel and the chamfer, and/or between the sealing rubber barrel and the retaining ring.

12. The new sliding sleeve according to claim 3, wherein a spacer is disposed on at least one side of the sealing rubber barrel, and at least one surface of the spacer is uneven, so that a gap exists between the sealing rubber barrel and the chamfer, and/or between the sealing rubber barrel and the retaining ring.

13. The new sliding sleeve according to claim 12, wherein concave-convex teeth, and/or a groove, and/or a ring groove, are disposed on at least one surface of the spacer.

14. The new sliding sleeve according to claim 1, wherein a movable space is formed among an inner surface of the outer housing, the inner sleeve and the lower connector, and a first dissolvable structure is filled in the movable space.

15. The new sliding sleeve according to claim 14, wherein an inner diameter of the first dissolvable structure is larger than or equal to the inner diameter of the inner sleeve, and the inner diameter of the first dissolvable structure is larger than or equal to an inner diameter of the lower connector.

16. The new sliding sleeve according to claim 14, wherein the first dissolvable structure is made of magnalium alloy, phenolic resin, urea resin, epoxy resin, or polyimide.

17. The new sliding sleeve according to claim 1, wherein a second dissolvable structure is further filled in the groove.

18. The new sliding sleeve according to claim 17, wherein an inner diameter of the second dissolvable structure is larger than or equal to the inner diameter of the inner sleeve.

19. The new sliding sleeve according to claim 17, wherein the second dissolvable structure is made of magnalium alloy, phenolic resin, urea resin, epoxy resin, or polyimide.

20. The new sliding sleeve according to claim 1, wherein an open/close structure is disposed between the inner sleeve and the outer housing, and the open/close structure enables the inner sleeve to be fixed when the inner sleeve closes or opens the flow guiding hole.

21. The new sliding sleeve according to claim 20, wherein the open/close structure is an arched position-limiting elastic piece, wherein a protrusion is disposed on the arched position-limiting elastic piece, and the protrusion can be fitted into a first slot or a second slot correspondingly disposed on an inner surface of the outer housing.

22. The new sliding sleeve according to claim 20, wherein the open/close structure is an anchor-fluke position-limiting elastic piece, wherein the anchor-fluke position-limiting elastic piece has anchor flukes, and the anchor flukes can be fitted into a first groove or a second groove correspondingly disposed on an inner surface of the outer housing.

23. The new sliding sleeve according to claim 20, wherein a first slot is close to the upper connector, and a second slot is close to the lower connector, wherein a side wall of the first slot close to the upper connector gradually inclines towards the upper connector, and an angle between a side wall of the first slot close to the lower connector and an inner surface of the outer housing is larger than 45°; and wherein a side wall of the second slot close to the lower connector gradually inclines towards the lower connector, and an angle between a side wall of the second slot close to the upper connector and the inner surface of the outer housing is larger than 45°.

24. The new sliding sleeve according to claim 20, wherein the open/close structure is an L-shaped groove, wherein an end of the L-shaped groove close to the lower connector is a closing block part extending along an axial direction of the inner sleeve, and an end of the L-shaped groove close to the upper connector is an opening block part extending along a direction perpendicular to an extending direction of the closing block part; and wherein the shear pin can be blocked at the closing block part or the opening block part.

25. The new sliding sleeve according to claim 20, wherein the open/close structure is a J-shaped groove, wherein an end of the J-shaped groove close to the lower connector is a closing block part extending along an axial direction of the inner sleeve, and an end of the J-shaped groove close to the upper connector is a triangular opening block part extending along a direction perpendicular to an extending direction of the closing block part; and wherein the shear pin can be blocked at the closing block part or the opening block part.

* * * * *